US009711849B1

(12) United States Patent
Chen et al.

(10) Patent No.: US 9,711,849 B1
(45) Date of Patent: Jul. 18, 2017

(54) ANTENNA RECONFIGURABLE CIRCUIT

(71) Applicant: NATIONAL CHUNG SHAN INSTITUTE OF SCIENCE AND TECHNOLOGY, Taoyuan (TW)

(72) Inventors: Wen-Shyh Chen, Taoyuan (TW); Yu-Tse Lin, Taoyuan (TW); Chang-Fa Yang, Taipei (TW); Wei-Shiuan Chang, Taichung (TW)

(73) Assignee: NATIONAL CHUNG SHAN INSTITUTE OF SCIENCE AND TECHNOLOGY (TW)

( * ) Notice: Subject to any disclaimer, the term of this patent is extended or adjusted under 35 U.S.C. 154(b) by 0 days.

(21) Appl. No.: 15/047,725

(22) Filed: Feb. 19, 2016

(51) Int. Cl.
*H01Q 5/00* (2015.01)
*H01Q 1/52* (2006.01)
*H01Q 21/00* (2006.01)

(52) U.S. Cl.
CPC ..... *H01Q 1/523* (2013.01); *H01Q 21/0075* (2013.01)

(58) Field of Classification Search
CPC ..... H01Q 1/523; H01Q 21/0075
USPC ..... 343/858
See application file for complete search history.

(56) References Cited

U.S. PATENT DOCUMENTS 8,674,888 B2 * 3/2014 Rofougaran ..... G06K 7/10237 343/722
2001/0025576 A1 * 10/2001 Gottling ..... B41F 13/08 101/216
2004/0201543 A1 * 10/2004 Gottl ..... H01Q 1/1207 343/912
2007/0195004 A1 * 8/2007 Rebeiz ..... H01Q 1/3233 343/876
2008/0088510 A1 * 4/2008 Murata ..... H01Q 3/24 343/700 MS (Continued)

FOREIGN PATENT DOCUMENTS

DE 3250133 B4 1/2005
EP 1340288 B1 10/2009

OTHER PUBLICATIONS

Cetiner, et al. "Monolitic Integration of RE MEMS Switches With a Diversity Antenna on PCB Substrate." IEEE Transactions on Microwave Theory and Techniques, vol. 51, No. Jan. 2003. pp. 332-335.

(Continued)

*Primary Examiner* — Dameon E Levi
*Assistant Examiner* — David Lotter
(74) *Attorney, Agent, or Firm* — Schmeiser, Olsen & Watts, LLP

(57) ABSTRACT

An antenna reconfigurable circuit changes patterns of a multiple-antenna system and includes a feed portion which an electrical signal is fed to; a plurality of power distribution links coupled between the feed portion and the antennas to form therebetween paths of transmission of the electrical signal; and switching units disposed at the power distribution links, respectively, to selectively disable or enable the paths. The switching units enable the antennas to change patterns and enhance signal reception quality. Furthermore, the antenna reconfigurable circuits are printed circuits instead of lumped elements and thereby maintain response characteristics, response stability and production yield of the antenna reconfigurable circuits.

6 Claims, 14 Drawing Sheets

(56) References Cited

U.S. PATENT DOCUMENTS

2015/0194736 A1* 7/2015 Diukman ..... H01Q 1/48
343/818

OTHER PUBLICATIONS

C. Kittiyanpunya et al, "A Four-Beam Pattern Reconfigurable Yagi-Uda Antenna," 2013, 5 Pages.

* cited by examiner

ANTENNA RECONFIGURABLE CIRCUIT

FIELD OF THE INVENTION

The present invention relates to reconfigurable circuits and, more particularly, to an antenna reconfigurable circuit which reconfigures antenna patterns.

BACKGROUND OF THE INVENTION

With demand surpassing supply in microwave frequency band, R&D of millimeter wave (mm-wave) frequency band is all the rage. Diffraction attenuation occurs to millimeter wave more than to microwave in the course of transmission, and thus millimeter wave-oriented antennas are required to achieve high gain. To ensure that full coverage will be exhibited by patterns of millimeter wave-oriented antennas, the prior art discloses an antenna system which comprises a plurality of antennas to change the patterns by selectively turning on different numbers of the antennas.

However, turning on different numbers of the antennas leads to a change in the input impedance of the antenna system. To always effectuate impedance matching in every instance of turning on different numbers of the antennas, the prior art discloses an antenna system which comprises different impedance matching circuits such that an appropriate one of the impedance matching circuits is selected with a switching device. However, the conventional antenna system has drawbacks as follows: the antenna system requires multiple impedance matching circuits and control circuits in order to select an appropriate one of the impedance matching circuits, thereby causing the conventional antenna system to be disadvantaged by bulkiness and complicated circuits; and the conventional impedance matching circuits are always lumped elements applicable to millimeter wave at the expense of cost-efficiency and error control, thereby deteriorating the yield of mass production of the impedance matching circuits.

Accordingly, it is imperative to provide an antenna reconfigurable circuit in order to overcome the drawbacks of the prior art.

SUMMARY OF THE INVENTION

It is an objective of the present invention to provide an antenna reconfigurable circuit for matching one or more antennas simultaneously.

Another objective of the present invention is to provide an antenna reconfigurable circuit with stable characteristics and high production yield.

In order to achieve the above and other objectives, the present invention provides an antenna reconfigurable circuit, disposed in a multiple-antenna system with a plurality of antennas and adapted to change patterns of the antennas, the antenna reconfigurable circuit comprising: a feed portion which an electrical signal is fed to; a plurality of power distribution links coupled between the feed portion and the antennas to form therebetween paths of transmission of the electrical signal; and switching units disposed at the power distribution links, respectively, to selectively disable or enable the paths.

In an embodiment of the present invention, a junction of the feed portion and each of the power distribution links is spaced apart from a corresponding one of the switching units by a distance equal to a half of a wavelength of a resonance frequency of the antennas.

In an embodiment of the present invention, the switching units are microelectromechanical systems (MEMS) switches or radio-frequency diodes.

In an embodiment of the present invention, the power distribution links, which are in number of four and disposed in a coplanar manner, are arranged in a cruciform manner by extending outward from the feed portion.

In an embodiment of the present invention, the switching units are each coupled to a bias voltage input line whereby a bias voltage is selectively input to start or shut down the switching unit.

In an embodiment of the present invention, the power distribution links each have a ground line with an electrical length which is n times one-fourth of a wavelength corresponding to a resonance frequency of the antennas, where n denotes a positive integer.

In an embodiment of the present invention, the power distribution links are implemented by microstrip lines.

The antenna reconfigurable circuits of the present invention comprises power distribution links and switching units disposed thereon so that not only can the antenna reconfigurable circuits match a single antenna, but the antenna reconfigurable circuits also match multiple antennas, to thereby reduce the required dimensions of the antenna reconfigurable circuits greatly, adjust the overall pattern of the antennas, so as to enhance the quality of signal reception. Furthermore, the antenna reconfigurable circuits are printed circuits instead of lumped elements so as to maintain the response characteristics of the antenna reconfigurable circuits, ensure the response stability of the antenna reconfigurable circuits, and enhance the yield of the production of the antenna reconfigurable circuits, despite any minor error in the width and length of the printed circuit manufactured by mass production.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1A:
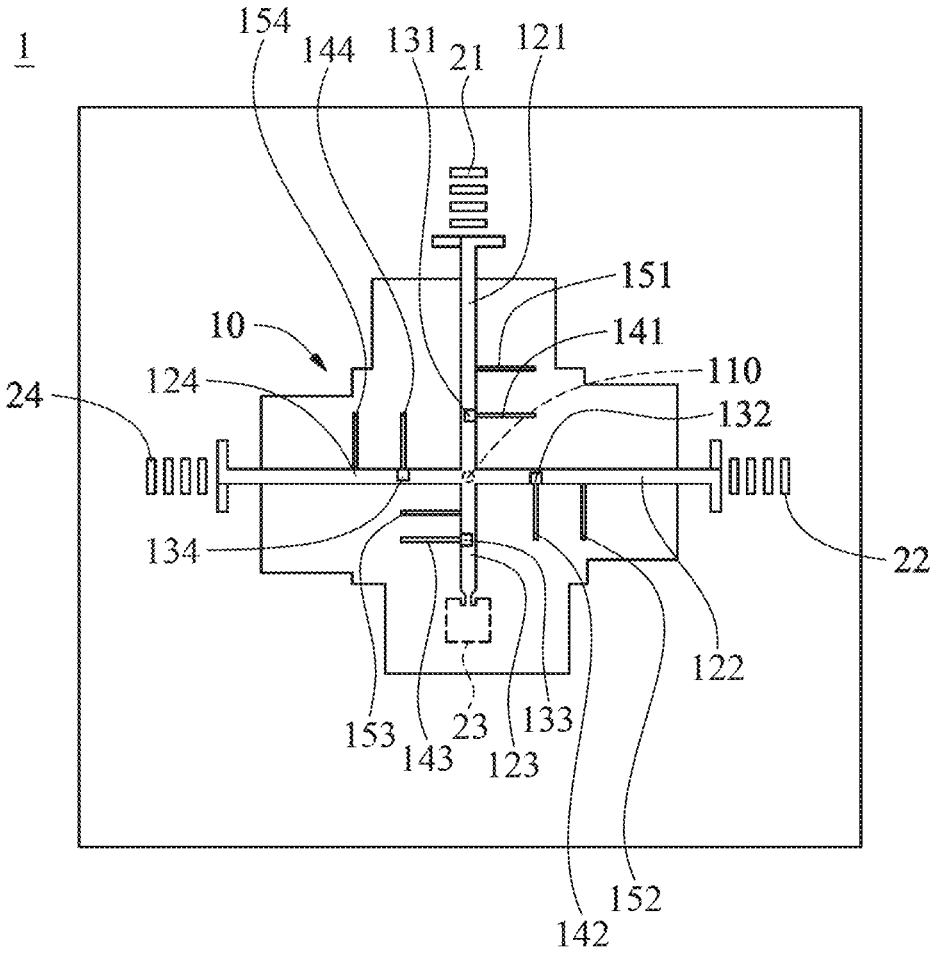
FIG. 1*a*, FIG. 1*b*, FIG. 1*c* and FIG. 1*d* are schematic views of an antenna reconfigurable circuit according to the first embodiment of the present invention.
Figure 1B:
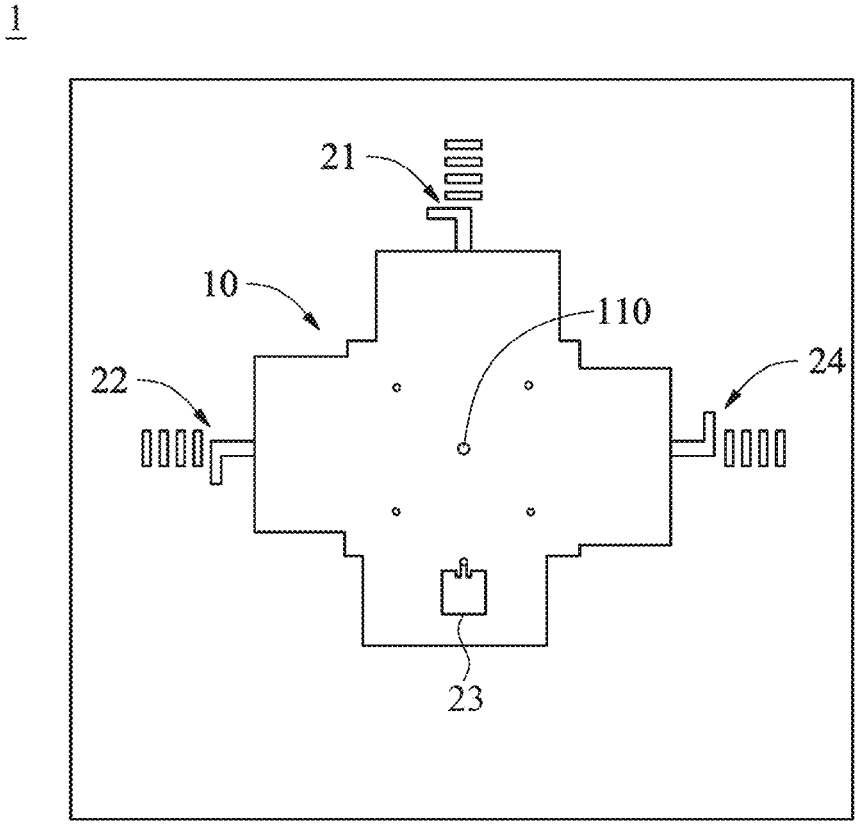
Figure 1C:
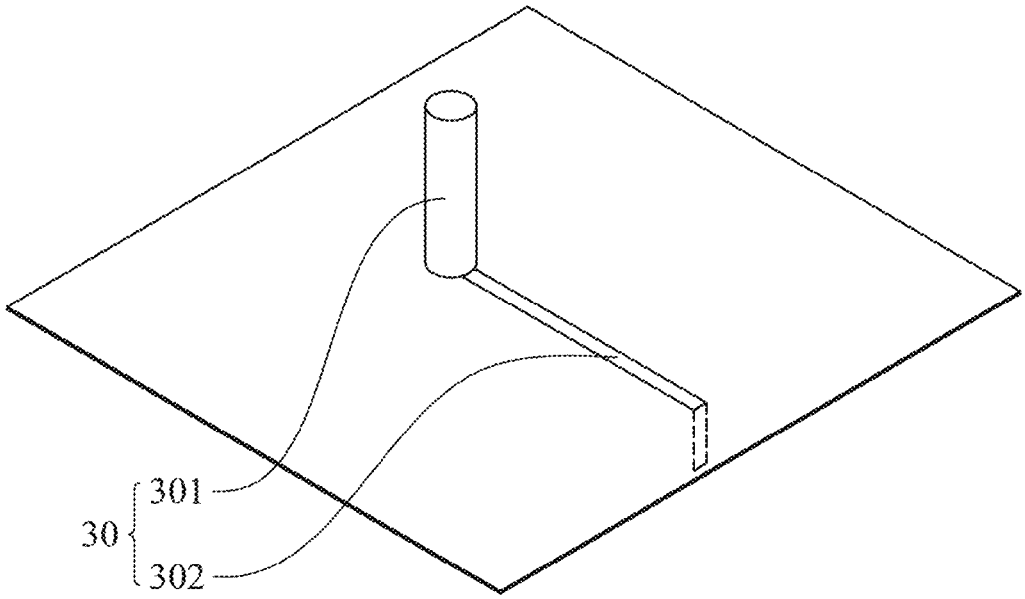
Figure 1D:
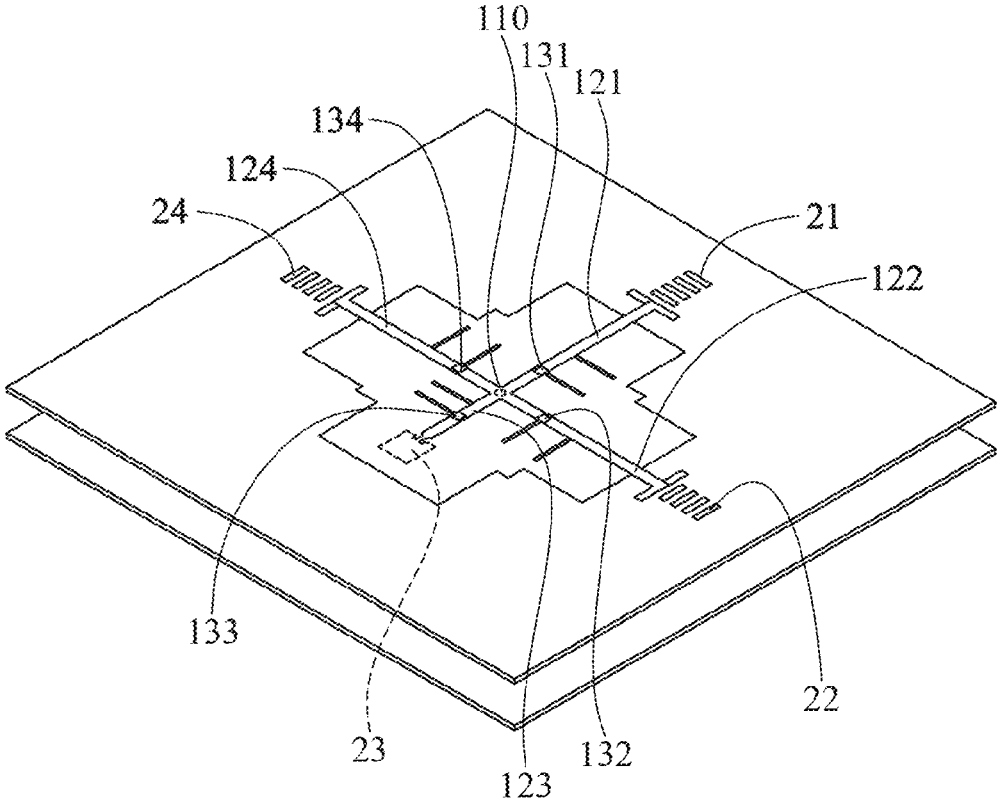

Referring to FIG. 1*a*, FIG. 1*b*, FIG. 1*c* and FIG. 1*d*, there are shown schematic views of an antenna reconfigurable circuit according to the first embodiment of the present invention. In this embodiment, the antenna reconfigurable circuit 10 is disposed in a multiple-antenna system 1 which is a bilayered 3D structure. FIG. 1*a* and FIG. 1*b* are schematic views of the first substrate of the multiple-antenna system 1. FIG. 1*c* is a schematic view of the second substrate of the multiple-antenna system 1. FIG. 1*d* is a schematic view of the first substrate and the second substrate of the multiple-antenna system 1. The substrates are printed circuit boards.

The antenna reconfigurable circuit 10 comprises a feed portion 110, four power distribution links 121, 122, 123, 124, and four switching units 131, 132, 133, 134. The antenna reconfigurable circuit 10, together with four directive antennas 21, 22, 23, 24 (optional), forms a multiple-antenna system 1. In this embodiment, the antennas 21, 22, 24 are Quasi Yagi-Uda antennas, whereas the antenna 23 is a rectangular patch antenna. The positions of the antennas 21, 22, 23, 24 are chosen with a view to ensure full coverage of antenna patterns in terms of the directions in which signals are received and sent. In this embodiment, the multiple-antenna system 1 is required to attain full coverage of signals, and thus the antennas 21, 22, 23, 24 are directed upward, downward, leftward, and rightward, respectively. The types, quantity and positions of the antennas of the present invention are subject to changes, and thus are not limited by the embodiments of the present invention.

An electrical signal (not shown) is fed to the feed portion 110 to drive the antennas 21, 22, 23, 24. In this embodiment, the multiple-antenna system 1 is a bilayered 3D structure. One end of the feed portion 110 is coupled to the power distribution links 121, 122, 123, 124, whereas the other end of the feed portion 110 is coupled to a communicating portion 30. Referring to FIG. 1*c*, the communicating portion 30 comprises a communicating post 301 and a matching unit 302. The antenna reconfigurable circuit 1 is coupled, through the communicating portion 30, to external circuits (not shown) disposed on different planes, respectively, and transmits electrical signals.

The power distribution links 121, 122, 123, 124 are coupled between the feed portion 110 and the antennas 21, 22, 23, 24, respectively, to form therebetween paths of transmission of the electrical signals. The power distribution links 121, 122, 123, 124 are implemented by substantially identical microstrip lines; hence, the power distribution links 121, 122, 123, 124 are substantially equal in specifications, such as electrical length and line width. The power distribution links 121, 122, 123, 124 are arranged in a cruciform manner. Therefore, the power of electrical signals input to the feed portion 110 is uniformly distributed between the power distribution links 121, 122, 123, 124.

The switching units 131, 132, 133, 134 are disposed at the power distribution links 121, 122, 123, 124, respectively, such that the power distribution links 121, 122, 123, 124 each have one said switching unit. The switching units 131, 132, 133, 134 selectively disable or enable the paths of transmission of electrical signals between the feed portion 110 and the antennas 21, 22, 23, 24. To allow the switching units to selectively shut down and thus disable the electrical signal transmission paths; hence, the input impedance of the power distribution links of the disabled electrical signal transmission paths is maximized to thereby make an open circuit. Therefore, the switching units 131, 132, 133, 134 are disposed at the power distribution links 121, 122, 123, 124, respectively. The power distribution links 121, 122, 123, 124 each join the feed portion 110. The junction of the feed portion 110 and each of the power distribution links 121, 122, 123, 124 is spaced apart from a corresponding one of the switching units 131, 132, 133, 134 by a distance equal to a half of the wavelength of the resonance frequency of the antennas 21, 22, 23, 24. Due to the aforesaid design, in an ideal situation, the power distribution links on the disabled electrical signal transmission paths do not suffer any energy loss, and thus energy carried by the electrical signals is fully distributed between and fed to the antennas coupled to the enabled power distribution links. In this embodiment, the antennas 21, 22, 23, 24 have a resonance frequency of 38 GHz, and thus the switching units 131, 132, 133, 134 have to be spaced apart from the feed portion 110 by $3.95*10^{-3}$ m or so. The switching units 131, 132, 133, 134 are coupled to bias voltage input lines 141, 142, 142, 144, respectively, and switched between a start state and a shut down state by an external control unit (not shown). The switching units 131, 132, 133, 134 are microelectromechanical systems (MEMS) switches or radio-frequency diodes.

The power distribution links 121, 122, 123, 124 have ground lines 151, 152, 153, 154, respectively. The power distribution links 121, 122, 123, 124 are grounded by the ground lines 151, 152, 153, 154, respectively. The present invention is not restrictive of the ground lines 151, 152, 153, 154. However, persons skilled in the art understand that radio-frequency signals of the multiple-antenna system 1 must not be affected by a control unit (not shown) which controls bias voltage input; to this end, the electrical length of a residual segment (such as a ground line) whose terminal end is attributed to a close circuit equals one-fourth of wavelength to thereby maximize the input impedance at the residual end, thus making an open circuit. Therefore, the characteristics of the radio-frequency signals of the multiple-antenna system 1 remain unaffected. Hence, the electrical length of the ground lines 151, 152, 153, 154 equals n times one-fourth of a wavelength corresponding to a resonance frequency of the antennas, where n denotes a positive integer. In this embodiment, the antennas 21, 22, 23, 24 have a resonance frequency of 38 GHz, and thus the ground lines 151, 152, 153, 154 have an electrical length of $1.96*10^{-3}*n$ meters.

Figure 2A:
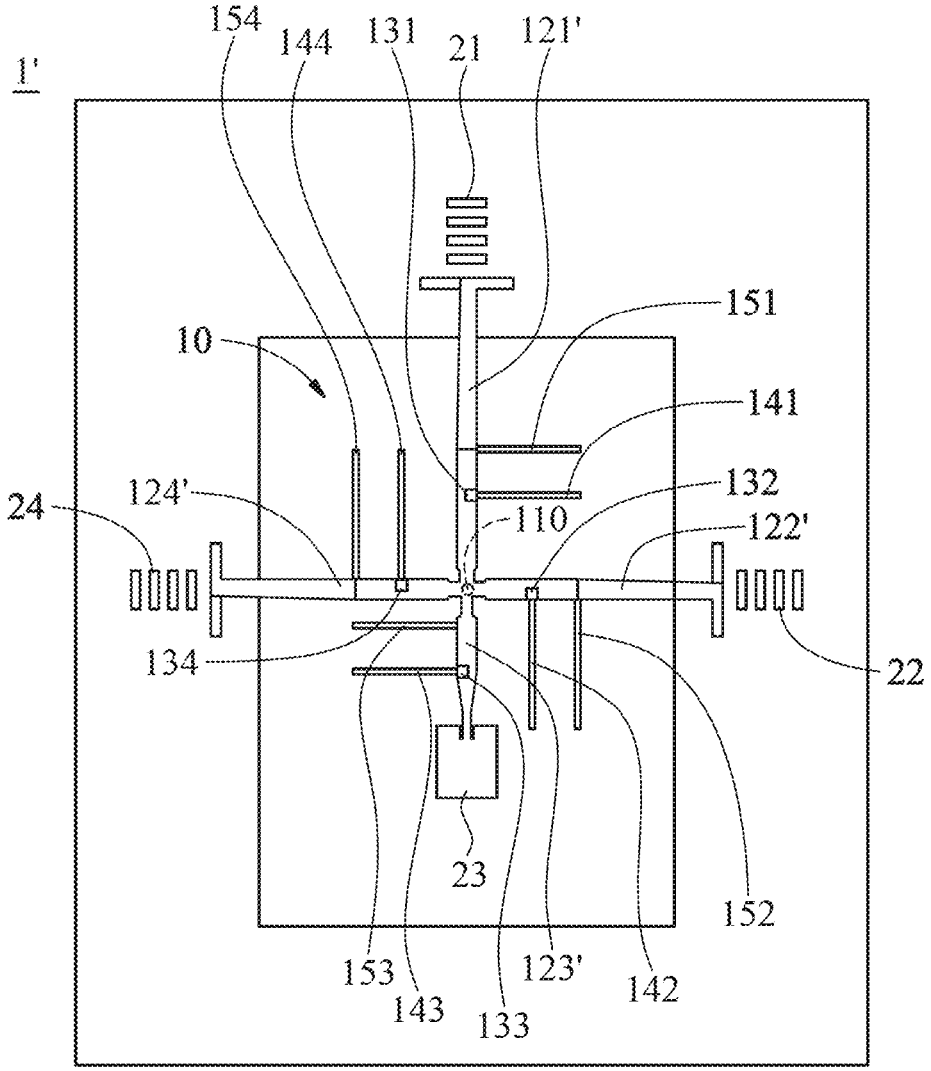
FIG. 2*a* and FIG. 2*b* are schematic views of an antenna reconfigurable circuit according to the second embodiment of the present invention.
Figure 2B:
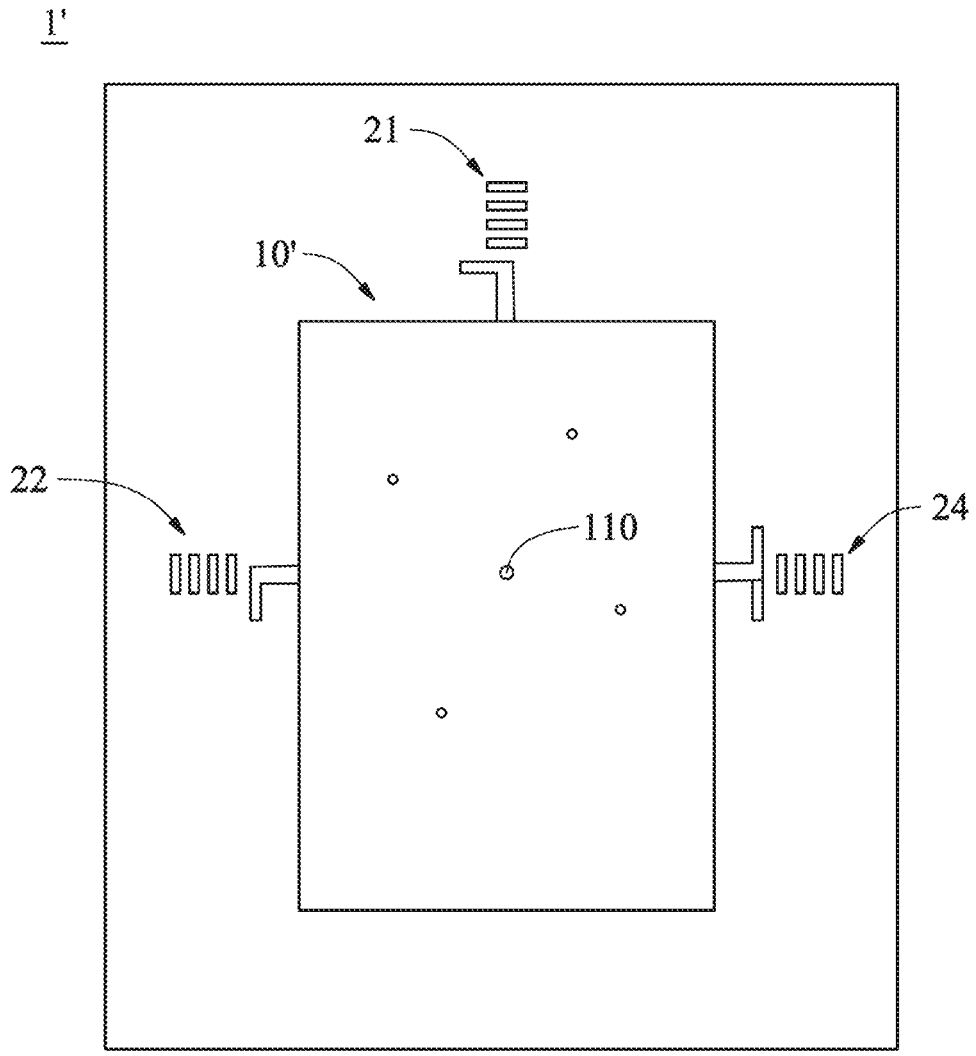

Referring to FIG. 2*a* and FIG. 2*b*, there are shown schematic views of an antenna circuit according to the second embodiment of the present invention. Unlike the multiple-antenna system 'which is bilayered, a multiple-antenna system 1' of the second embodiment is monolayered.

To effectuate the monolayered multiple-antenna system 1' of the second embodiment, power distribution links 121', 122', 123', 124' of an antenna reconfigurable circuit 10' are implemented by microstrip lines. A portion of the power distribution links 121', 122', 123', 124' is positioned proximal to the feed portion 110 and has a small line width (i.e., is narrow), whereas the other portion of the power distribution links 121', 122', 123', 124' is positioned distal to the feed portion 110 and has a large line width (i.e., is wide). Given the aforesaid design, although only one of the antennas 21, 22, 23, 24 is driven to start (i.e., only one of the switching units 131, 132, 133, 134 is in an ON state) and thus has high input impedance, the antennas 21, 22, 23, 24 have response bandwidth which fall within an allowed range. With an increasingly large number of the antennas 21, 22, 23, 24 being ON, the multiple-antenna system 1' has its equivalent input impedance decreased; hence, the power distribution links 121', 122', 123', 124' configured to operate at high impedance compensate for the decrease in the input impedance such that different numbers of the antennas 21, 22, 23, 24 are ON and still have satisfactory response bandwidth.

Figure 3A:
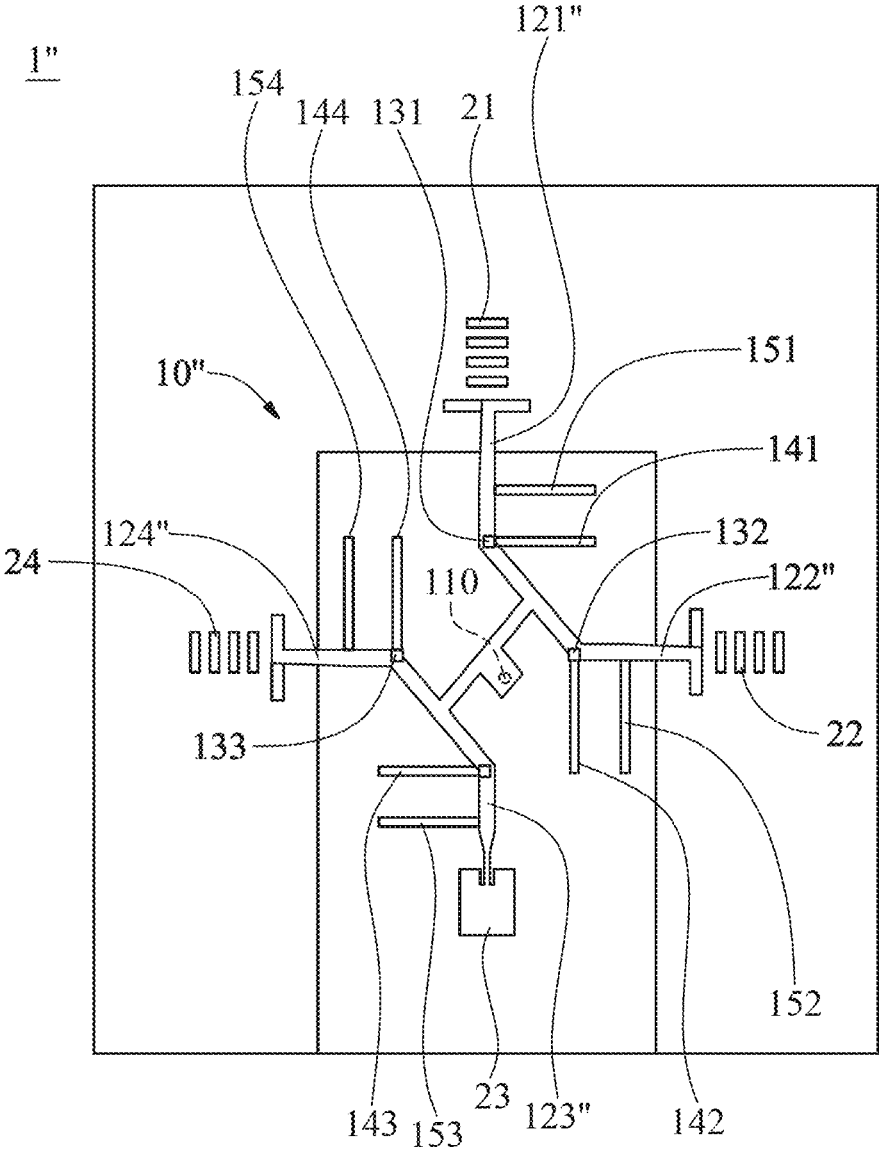
FIG. 3*a* and FIG. 3*b* are schematic views of an antenna reconfigurable circuit according to the third embodiment of the present invention.
Figure 3B:
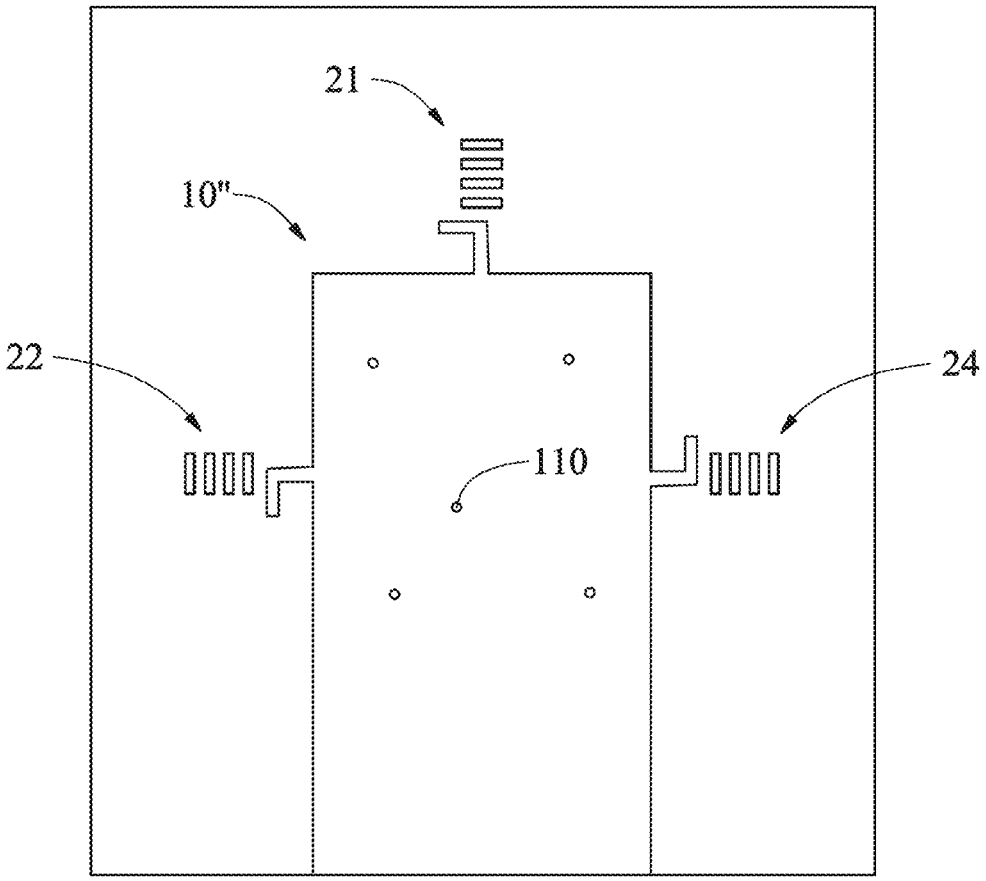

Referring to FIG. 3*a* and FIG. 3*b*, there are shown schematic views of an antenna reconfigurable circuit according to the third embodiment of the present invention. Like the multiple-antenna system 1' of the second embodiment, a multiple-antenna system 1" of the third embodiment is monolayer. However, the multiple-antenna system 1" of the third embodiment features a unique layout of the power distribution links 121", 122", 123", 124".

Unlike the antenna reconfigurable circuit 10 and the antenna reconfigurable circuit 10', an antenna reconfigurable circuit 10" of the third embodiment is characterized in that: the electrical signal divides into four parts when fed into the antenna reconfigurable circuit 10", and the antenna reconfigurable circuit 10" comprises three T-shaped microstrip power dividers; when fed, the power of the electrical signal is divided into two halves by first T-shaped microstrip power divider, and then the first half and the second half of the power of the electrical signal are each divided into two parts by the second and third T-shaped microstrip power dividers, respectively. Unlike the second embodiment, the third embodiment has such a unique circuit layout that it provides additional space for accommodating matching circuits. Therefore, the coefficient of reflection of the multiple-antenna system 1" operating at the operating frequency in the third embodiment has a larger available bandwidth than the coefficient of reflection of the multiple-antenna system 1' operating at the operating frequency in the second embodiment, so as to ensure an optimal response bandwidth when turning on different numbers of the antennas 21, 22, 23, 24.

Figure 4A:
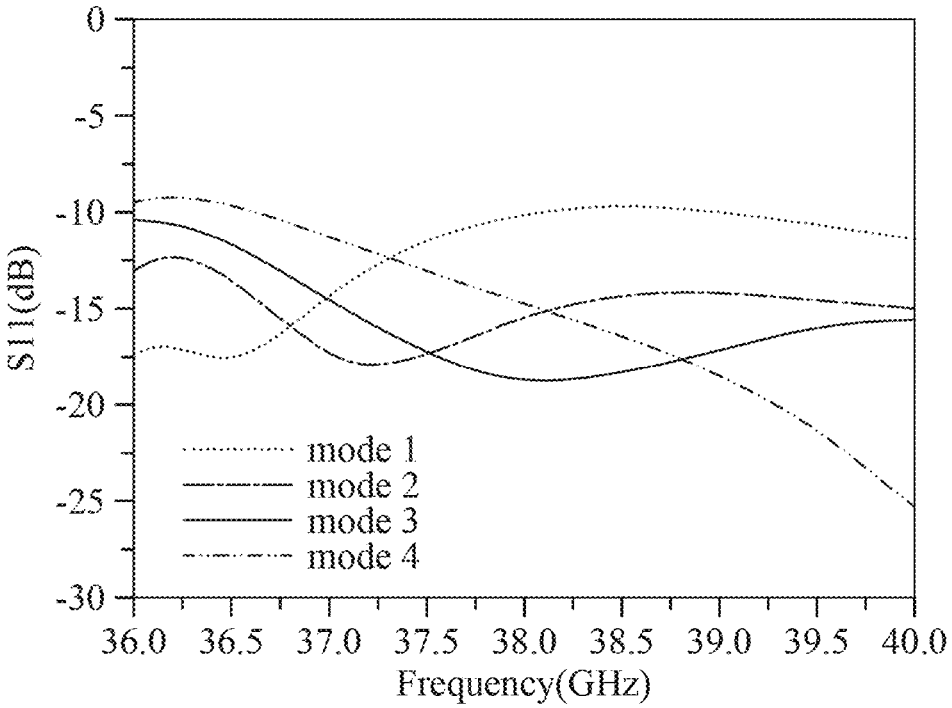
FIG. 4*a*, FIG. 4*b* and FIG. 4*c* are graphs of coefficient of reflection (S11) against frequency of a multiple-antenna system having the antenna reconfigurable circuit according to the first, second and third embodiments of the present invention, respectively.
Figure 4B:
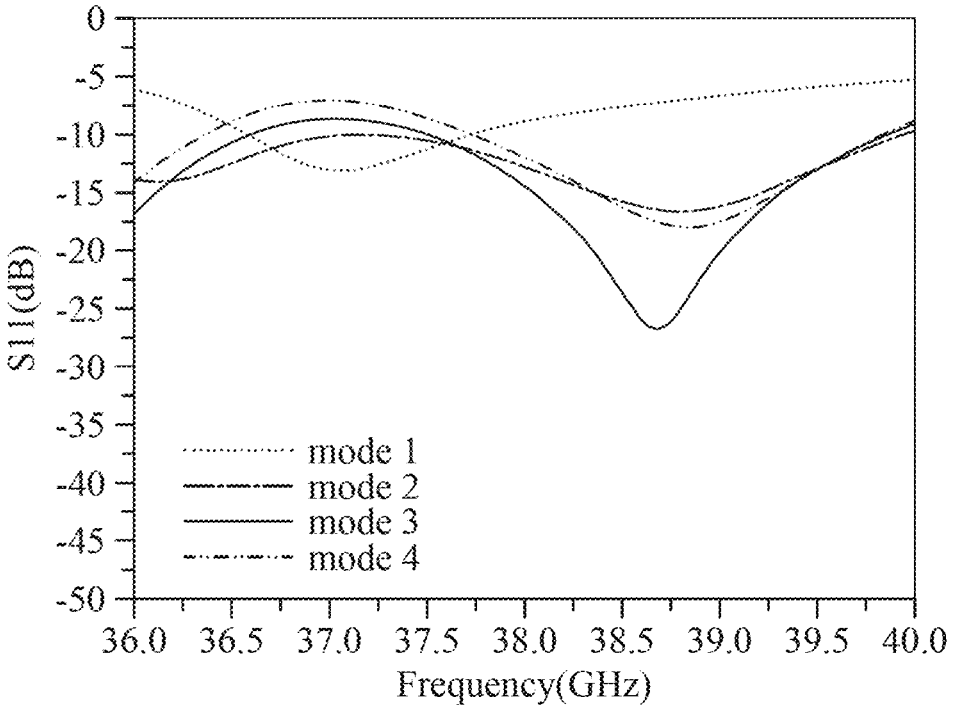
Figure 4C:
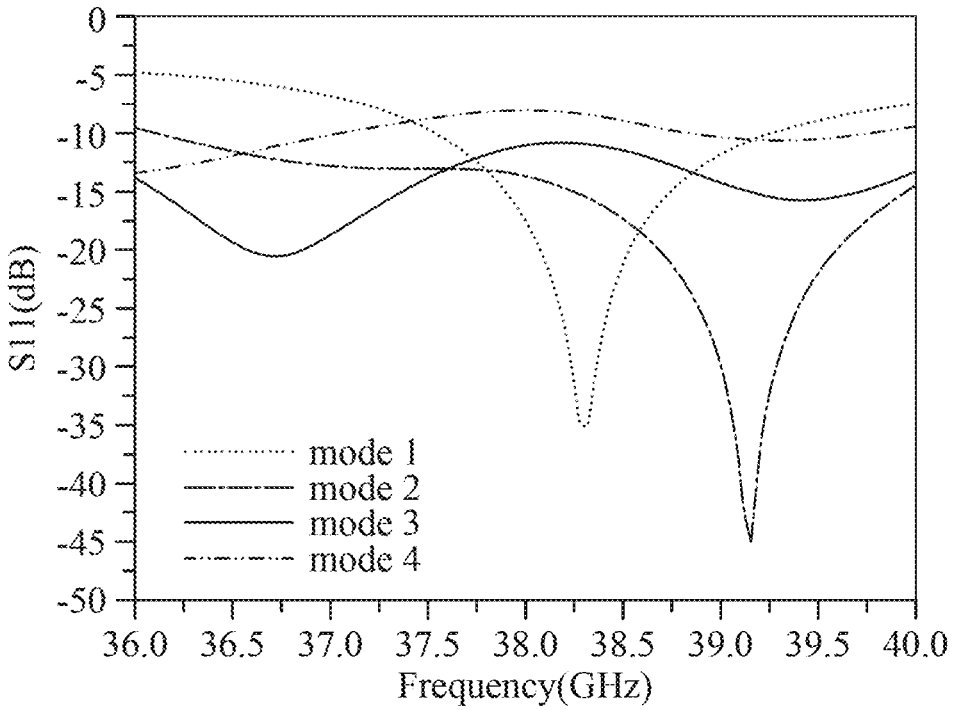

Referring to FIG. 4*a*, FIG. 4*b* and FIG. 4*c* are graphs of coefficient of reflection (S11) against frequency in the multiple-antenna system 1, the multiple-antenna system 1' and the multiple-antenna system 1", respectively. As shown in the drawings, mode 1 denotes the situation where only the antenna 23 is ON. Mode 2 denotes the situation where the antennas 22, 23 are ON. Mode 3 denotes the situation where the antennas 21, 22, 23 are ON. Mode 4 denotes the situation where all the antennas 21, 22, 23, 24 are ON.

With the multiple-antenna system 1 being bilayered, the multiple-antenna system 1 exhibits a large bandwidth in terms of the relationship of coefficient of reflection (S11) against frequency when the antennas 21, 22, 23, 24 are ON. By contrast, with the multiple-antenna system 1' being monolayered, the variation in the line width of the power distribution links 121', 122', 123', 124' is effective in achieving matching, not to mention that the manufacturing of the multiple-antenna system 1' is rendered easy. However, the multiple-antenna system 1' has a smaller response bandwidth than the multiple-antenna system 1. The multiple-antenna system 1" is monolayered. The power distribution links 121", 122", 123", 124" each comprise three T-shaped microstrip power dividers. The response bandwidth of the multiple-antenna system 1" lies between the response bandwidth of the multiple-antenna system 1 and the response bandwidth of the multiple-antenna system 1'.

Figure 5A:
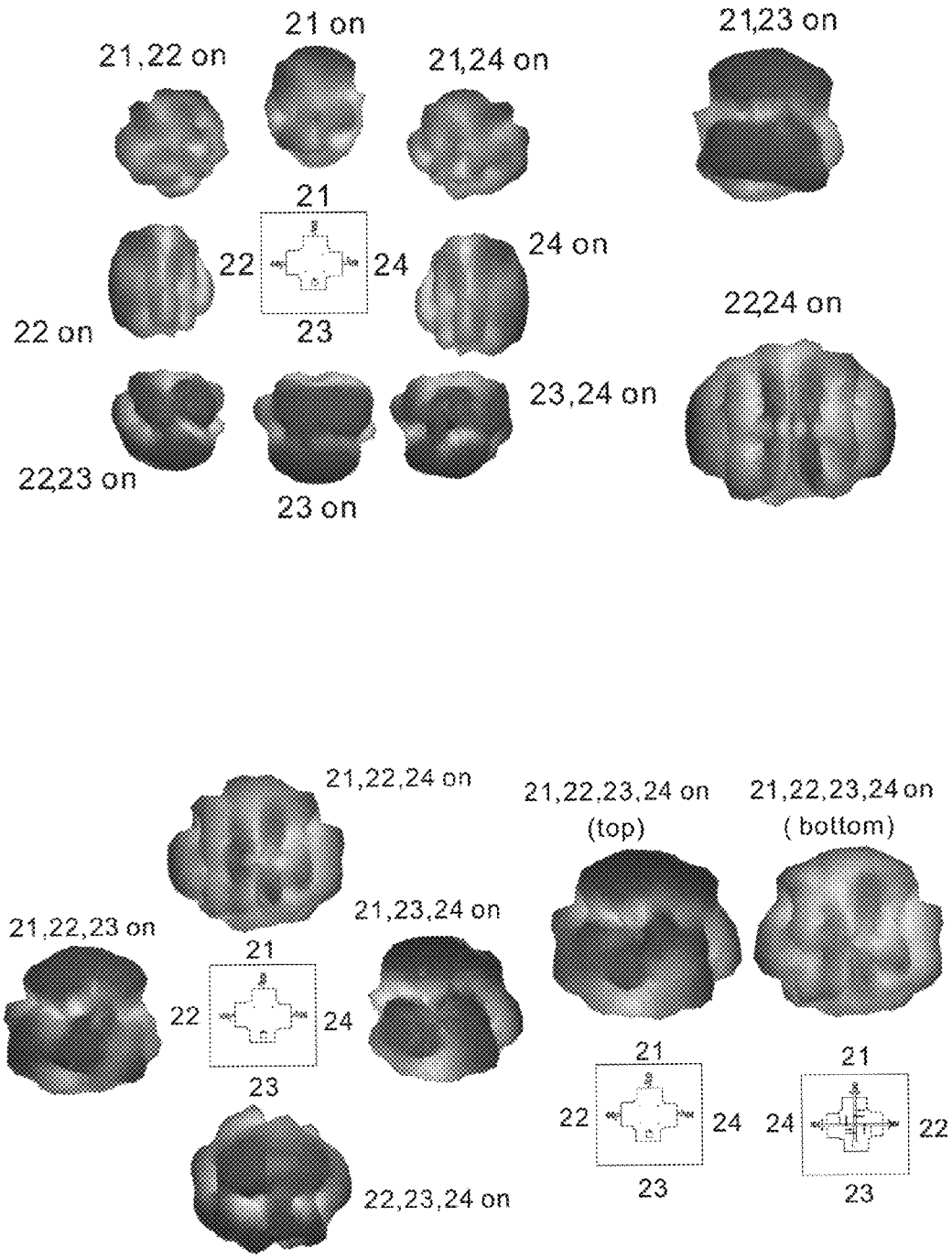
FIG. 5*a*, FIG. 5*b* and FIG. 5*c* are schematic views of measurements of patterns exhibited when turning on different numbers of antennas of the multiple-antenna system having the antenna reconfigurable circuit according to the first, second and third embodiments of the present invention, respectively.
Figure 5B:
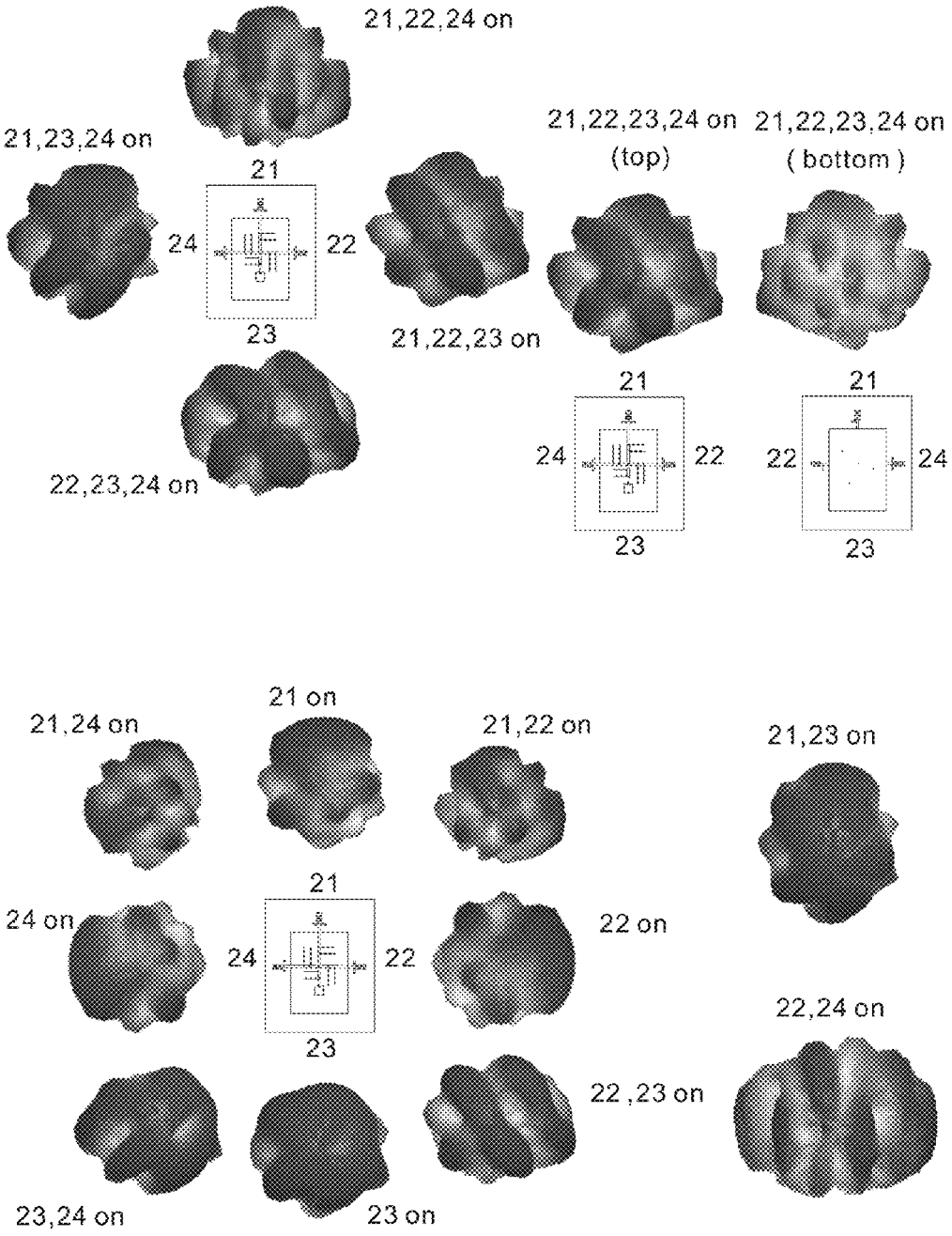
Figure 5C:
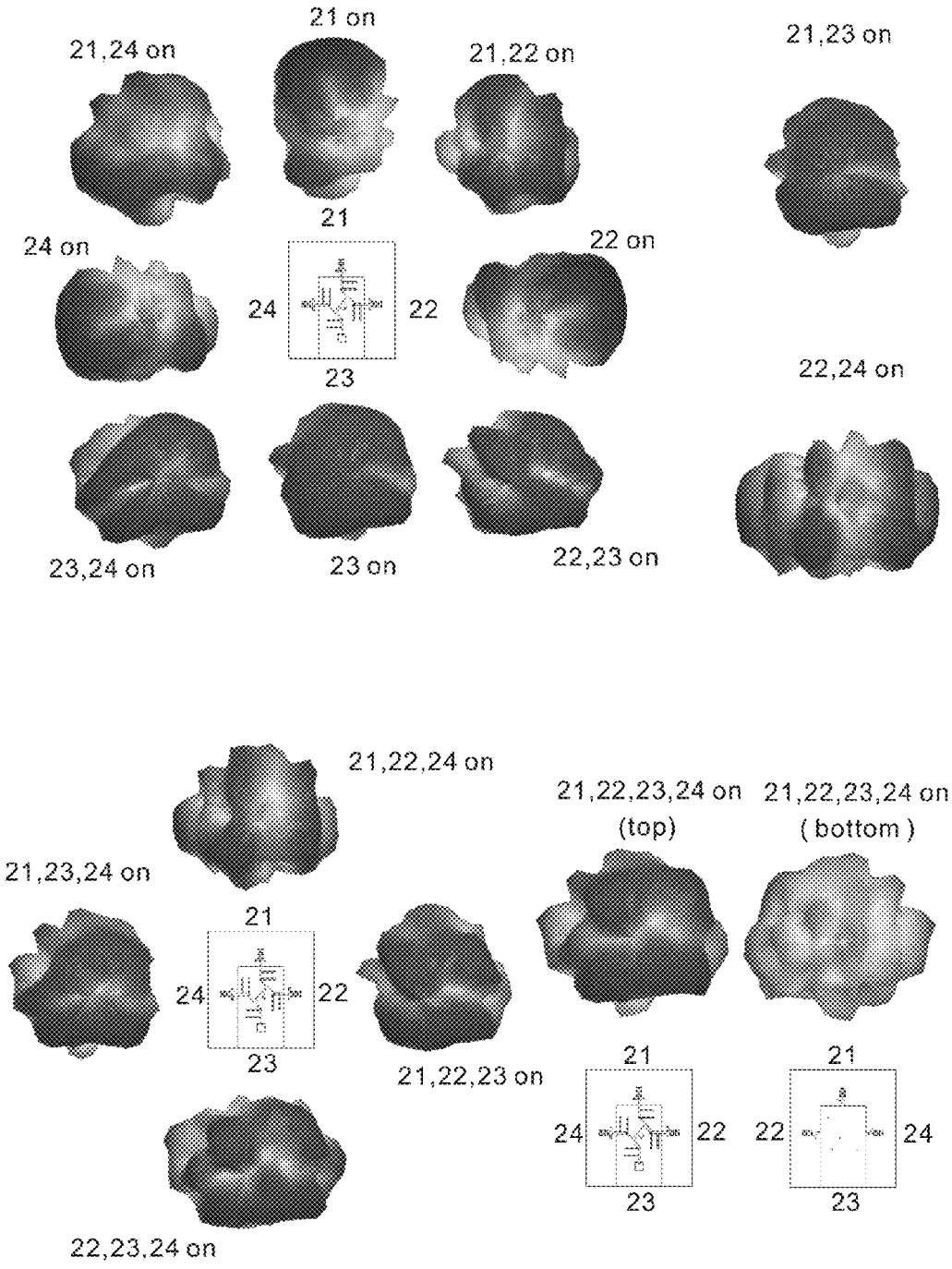

Referring to FIG. 5*a*, FIG. 5*b* and FIG. 5*c* are schematic views of measurements of patterns exhibited when different numbers of antennas of the multiple-antenna system 1 are ON, the multiple-antenna system 1' and the multiple-antenna system 1" having the antenna reconfigurable circuits according to the first, second and third embodiments of the present invention, respectively. The reference numerals shown in the diagrams indicate the antennas which are ON and thus produce the pattern. For example, the diagram with reference numerals 22, 23 depicts the pattern arising from the antennas 22, 23 which are ON, whereas the diagram with reference numerals 21, 22, 23 depicts the pattern arising from the antennas 21, 22, 23 which are ON. Furthermore, the diagram with the word "top" depicts the pattern produced and measured from the top of the multiple-antenna system when all the antennas 21, 22, 23, 24 are ON, whereas the diagram with the word "bottom" depicts the pattern produced and measured from the bottom of the multiple-antenna system when all the antennas 21, 22, 23, 24 are ON. The antenna 23 is disposed on a surface of the substrate, and surface of the substrate is regarded as the top of the multiple-antenna system. The opposing surface of the substrate is regarded as the bottom of the multiple-antenna system.

The multiple-antenna systems 1, 1', 1" are equipped with the antenna reconfigurable circuits 10, 10', 10" of the present invention, respectively. The switching units 131, 132, 133, 134 enable the multiple-antenna systems 1, 1', 1" to change patterns thereof so that the patterns of the multiple-antenna systems 1, 1', 1" switch between a directive mode, an omnidirectional mode, and opposite mode, and in consequence the quality of communication effectuated by mobiles devices can be enhanced by selecting an appropriate antenna pattern and direction according to the environment which the multiple-antenna systems 1, 1', 1" are operating in.

The antenna reconfigurable circuits of the present invention comprises power distribution links and switching units disposed thereon so that not only can the antenna reconfigurable circuits match a single antenna, but the antenna reconfigurable circuits also match multiple antennas, to thereby reduce the required dimensions of the antenna reconfigurable circuits greatly, adjust the overall pattern of the antennas, so as to enhance the quality of signal reception. Furthermore, the antenna reconfigurable circuits are printed circuits instead of lumped elements so as to maintain the response characteristics of the antenna reconfigurable circuits, ensure the response stability of the antenna reconfigurable circuits, and enhance the yield of the production of the antenna reconfigurable circuits, despite any minor error in the width and length of the printed circuit manufactured by mass production.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. An antenna reconfigurable circuit, disposed in a multiple-antenna system with a plurality of antennas and adapted to change patterns of the antennas, the antenna reconfigurable circuit comprising:

a feed portion which a radio frequency (RF) signal is fed to;

power distribution lines, coupled between the feed portion and the plurality of antennas to form therebetween paths of transmission of the RF signal, and the power distribution lines comprising a first power distribution line, a second power distribution line, a third power distribution line, and a fourth power distribution line, wherein each of the power distribution lines has an end coupled to a corresponding one of the plurality of antennas and has another end coupled to the feed portion; and switching units, disposed on the power distribution lines, respectively, to selectively disable or enable the paths so as to turn off or on the plurality of antennas selectively, and comprising a first switching unit, a second switching unit, a third switching unit, and a fourth switching unit, wherein each of the switching units lies between a corresponding one of the power distribution lines and the feed portion;

wherein the power distribution lines each comprises a ground line, perpendicular to a corresponding path of transmission of the RF signal of the power distribution line, and with an electrical length which is n times one-fourth of a wavelength corresponding to a resonance frequency of the antenna coupled to the power distribution line, where n denotes a positive integer;

wherein, when the first switching unit is turned on, the first power distribution line forms a first path of transmission of the RF signal to a first antenna of the plurality of antennas; when the second switching unit is turned on, the second power distribution line forms a second path of transmission of the RF signal to a second antenna of the plurality of antennas; when the third switching unit is turned on, the third power distribution line forms a third path of transmission of the RF signal to a third antenna of the plurality of antennas; when the fourth switching unit is turned on, the fourth power distribution line forms a fourth path of transmission of the RF signal to a fourth antenna of the plurality of antennas.

2. The antenna reconfigurable circuit of claim 1, wherein a junction of the feed portion and each of the power distribution lines is spaced apart from a corresponding one of the switching units by a distance equal to a half of a wavelength of a resonance frequency of the plurality of antennas.

3. The antenna reconfigurable circuit of claim 1, wherein the switching units are microelectromechanical systems (MEMS) switches or radio-frequency diodes.

4. The antenna reconfigurable circuit of claim 1, wherein the power distribution lines, which are in number of four and disposed in a coplanar manner, are arranged in a cruciform manner by extending outward from the feed portion.

5. The antenna reconfigurable circuit of claim 1, wherein the switching units are each coupled to a bias voltage input line whereby a bias voltage is selectively input to start or shut down the switching units.

6. The antenna reconfigurable circuit of claim 1, wherein the power distribution lines are implemented by microstrip lines.

* * * * *